US006138871A

United States Patent [19]

D'Andrade

[11] Patent Number: 6,138,871

[45] Date of Patent: Oct. 31, 2000

[54] SINGLE TANK WATER GUN WITH ONBOARD PUMP AND QUICK-CHARGING NOZZLE CONNECTION

[75] Inventor: Bruce M. D'Andrade, deceased, late of Whitehouse Station, N.J., by Mary Ann D'Andrade, executrix

[73] Assignee: Larami Limited, Mt. Laurel, N.J.

[21] Appl. No.: 09/227,061

[22] Filed: Jan. 5, 1999

Related U.S. Application Data

[60] Provisional application No. 60/088,952, Jun. 11, 1998.

[51] Int. Cl.[7] ..... A63H 3/18; B67B 7/00; B65B 3/04

[52] U.S. Cl. ..... 222/79; 222/1; 141/2; 141/18; 141/351

[58] Field of Search ..... 222/78, 79, 401.16, 222/1; 141/351, 2, 18

[56] References Cited

U.S. PATENT DOCUMENTS

| | | |
|---|---|---|
| 2,249,608 | 7/1941 | Greene . |
| 3,005,577 | 10/1961 | Webster . |
| 3,578,789 | 5/1971 | Ferri . |
| 4,135,559 | 1/1979 | Barnby . |
| 4,257,460 | 3/1981 | Paranay et al. . |
| 4,673,010 | 6/1987 | Prufer et al. . |
| 4,854,480 | 8/1989 | Shindo . |
| 5,074,437 | 12/1991 | D'Andrade et al. . |
| 5,127,118 | 7/1992 | Johenning . |
| 5,339,987 | 8/1994 | D'Andrade . |
| 5,366,108 | 11/1994 | Darling . |
| 5,373,975 | 12/1994 | Husted . |
| 5,531,626 | 7/1996 | Deal . |
| 5,531,627 | 7/1996 | Deal . |
| 5,850,941 | 12/1998 | Johnson et al. . |
| 5,915,771 | 6/1999 | Amron . |

OTHER PUBLICATIONS

Yes! Entertainment Speed Loader 1500 instructions. ©1997. Not admitted as prior art.

*Primary Examiner*—Kevin Shaver
*Assistant Examiner*—Keats Quinalty
*Attorney, Agent, or Firm*—Akin, Gump, Strauss, Hauer & Feld, L.L.P.

[57] ABSTRACT

A toy water gun for ejecting a liquid is provided. The toy gun includes a housing and a pressurizable storage tank which receives liquid and is connected to the housing. Also provided on the housing is a pump which is adapted to pressurize the liquid in the pressurizable storage tank. In addition, a release valve is located in the housing. The gun includes a path of fluid communication between the pressurizable storage tank, the pump and the release valve. The release valve is adapted to regulate a discharge of liquid from the pressurizable storage tank, and a trigger is attached to the release valve. Also connected to the release valve is a nozzle assembly adapted for insertion into a recharge adapter to force liquid through the nozzle assembly displacing the release valve in such a way that allows liquid to flow through a part of said path of fluid communication and into the pressurizable storage tank. In this way, air is compressed in the pressurizable storage tank to charge the pressurizable storage tank with liquid under pressure. Movement of the trigger in turn displaces the release valve regulating the discharge of liquid from the pressurizable storage tank and out said nozzle.

11 Claims, 4 Drawing Sheets

SINGLE TANK WATER GUN WITH ONBOARD PUMP AND QUICK-CHARGING NOZZLE CONNECTION

CROSS REFERENCE TO RELATED APPLICATIONS

This application claims the benefit of U.S. Provisional application Ser. No. 60/088,952, filed Jun. 11, 1998.

BACKGROUND OF THE INVENTION

Water guns having an onboard water reservoir which can be pressurized with air are known. Such guns typically utilize a pump located on the water gun which can be used to pump air into the water reservoir in order to pressurize the water therein such that when the trigger is pulled, a stream of water is ejected from the water gun that lasts as long as the trigger is engaged or until the pressure of the water equals ambient pressure. One such water gun is disclosed in Applicant's prior U.S. Pat. No. 5,074,437.

It would be desirable to provide a water gun which can be operated in the above-noted manner which can also be simultaneously charged with water and pressurized from an external source of pressurized water. This would provide for enhanced enjoyment and ease of use, especially for younger users who may have difficulty using the manual pump. Additionally, it would be desirable to maintain the ability to pressurize the water gun using a manual pump located on the gun when an external source of pressurized water is not available. Other improvements which should reduce the cost of manufacturing are also provided.

SUMMARY OF THE INVENTION

The present invention is directed to a toy gun for ejecting a liquid having a housing and a pressurizable storage tank which receives liquid and is connected to the housing. Also provided on the housing is a pump which is adapted to pressurize the liquid in the pressurizable storage tank. In addition, a release valve is located in the housing. The gun includes a path of fluid communication between the pressurizable storage tank, the pump and the release valve. The release valve is adapted to regulate a discharge of liquid from the pressurizable storage tank, and a trigger is attached to the release valve. Also connected to the release valve is a nozzle assembly adapted for insertion into a recharge adapter to force liquid through the nozzle assembly displacing the release valve in such a way that allows liquid to flow through a part of said path of fluid communication and into the pressurizable storage tank. In this way, air is compressed in the pressurizable storage tank to charge the pressurizable storage tank with liquid under pressure. Movement of the trigger in turn displaces the release valve regulating the discharge of liquid from the pressurizable storage tank and out said nozzle.

In another aspect there is shown a toy gun system including a toy gun and a recharge adapter. The toy gun includes a housing, a pressurizable storage tank for liquid removably attached to the housing, and a pump connected to the housing. The pump is adapted to pressurize a liquid in the pressurizable storage tank. A release valve is also located in the housing. A path of fluid communication is provided between the pressurizable storage tank, the pump and the release valve, with the release valve being adapted to regulate a discharge of liquid from the pressurizable storage tank. In addition, the toy gun has a trigger connected to the release valve and a nozzle assembly. The nozzle assembly includes a nozzle assembly housing which is connected to the release valve and adapted for insertion into a recharge adapter to force liquid through the nozzle assembly to displace the release valve such that liquid flows through a part of the path of fluid communication and into the pressurizable storage tank which compresses air in the storage tank to charge the pressurizable storage tank with liquid under pressure. The nozzle assembly includes a discharge opening and at least one recharge channel. The recharge adapter of the toy gun system includes a hose attachment on the recharge adapter which is adapted to be connected to an external source of pressurized liquid. A valve body is located in the recharge adapter and has a path defined therethrough. A receptacle is located on the adapter for receiving the nozzle assembly. Upon insertion of the nozzle assembly into the receptacle, the valve body is adapted to be displaced to an open position allowing pressurized liquid from the external source to travel through the recharge adapter and into the nozzle assembly.

In another aspect of the invention, a method of operating a toy gun is taught. The method includes:

(a) providing a toy water gun having a housing, a handle on the housing, a storage tank removably attached to the housing, a pump attached to the housing and in fluid communication with a nozzle assembly, and a path of fluid communication between the storage tank, the pump and a release valve;

(b) filling and pressurizing the storage tank by one of:

(i) directing liquid in to the storage tank and pumping the pump to force air into the storage tank; and (ii) inserting the nozzle assembly in a receptacle of a recharge adapter thereby moving a normally closed valve to an open position, allowing liquid to flow through the normally closed valve, through the nozzle assembly and into the storage tank, pressurizing air in the storage tank;

(c) discharging liquid from the storage tank by actuating the release valve; and (d) refilling the toy gun in accordance with step (b) above.

BRIEF DESCRIPTION OF THE DRAWINGS

The foregoing summary, as well as the following detailed description of the preferred embodiment of the invention, will be better understood when read in conjunction with the appended drawings. For the purpose of illustrating the invention, there is shown in the drawings an embodiment which is presently preferred. It should be understood, however, that the invention is not limited to the precise arrangements and instrumentalities shown. In the drawings.

DETAILED DESCRIPTION OF THE INVENTION

Figure 1:
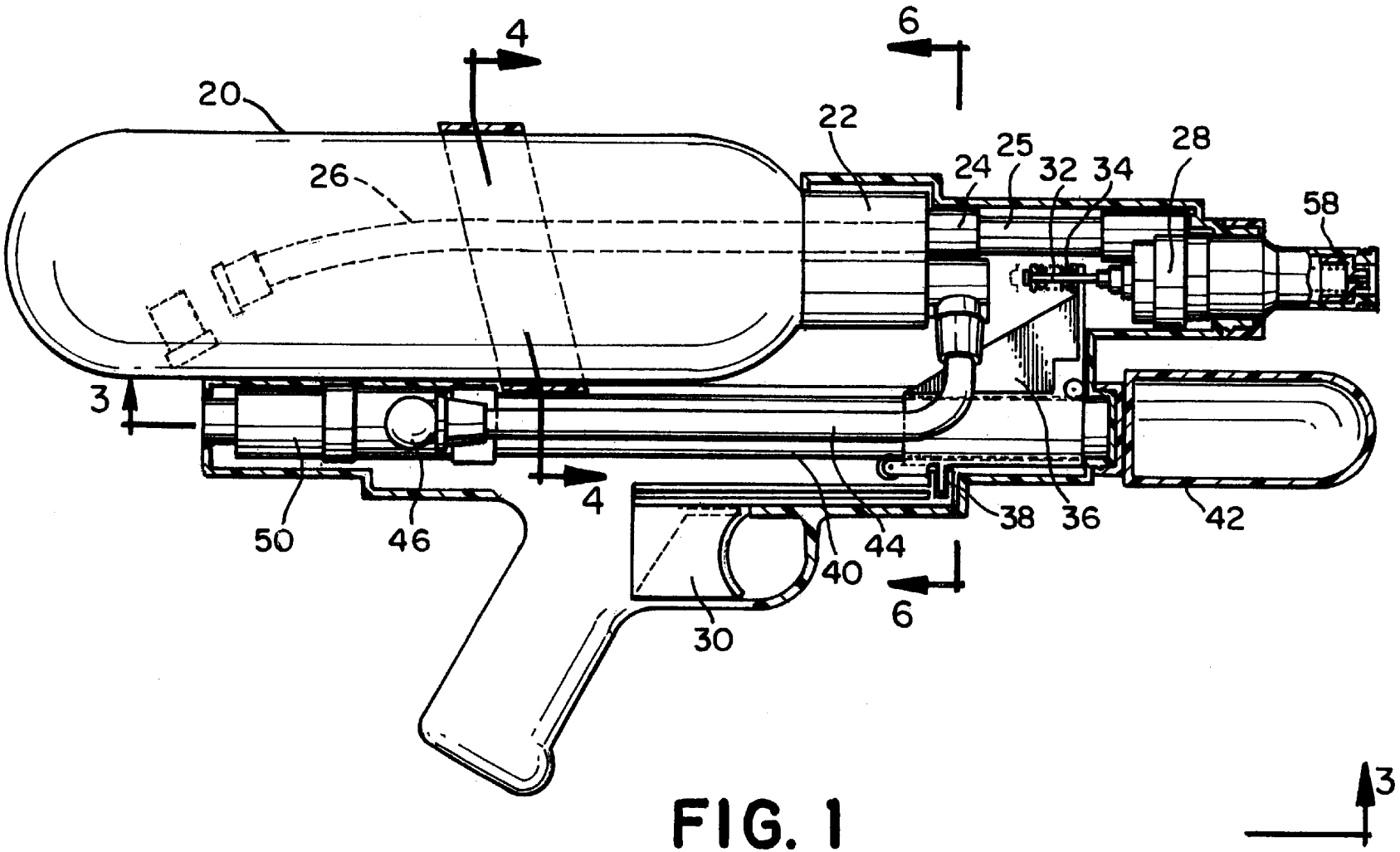
FIG. 1 is a left side elevational view, partially in cross section, showing a water gun in accordance with the present invention.
Figure 2:
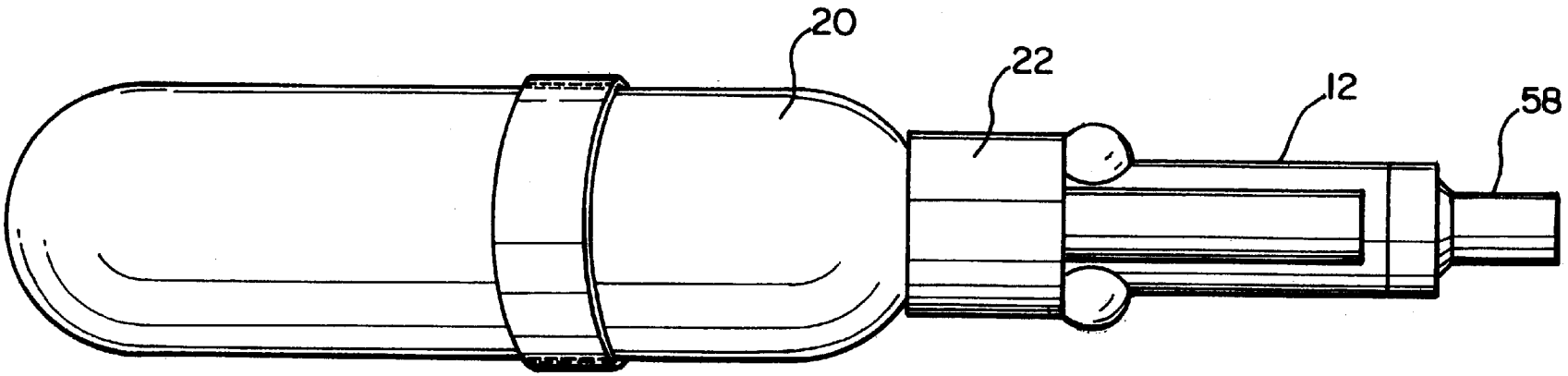
FIG. 2 is a top plan view thereof.

Certain terminology is used in the following description for convenience and is not limiting. The words "right," "left," "lower" and "upper" designate directions in the drawings to which reference is made. The words "inwardly" and "outwardly" refer to directions toward and away from respectively, the geometric center of the toy water gun in accordance with the present invention, and designated parts thereof. The terminology includes the words noted above, as well as derivatives thereof and words of similar import.

Referring now to FIGS. 1–9, there is shown a water gun 10 in accordance with the present invention. While the preferred embodiments of the invention are directed to water guns, it will be recognized by those skilled in the art that the toy gun 10 can be used with any liquid. For the sake of convenience, the preferred embodiments will therefore be described as water guns, although this is not intended to limit the present invention from use with other liquids. The water gun 10 operates in a similar manner to the water gun disclosed in Applicant's prior U.S. Pat. No. 5,074,437, which is incorporated herein by reference as if fully set forth. The water gun 10 includes a housing 12, having a handle 14. A pressurizable storage tank 20 is located on the housing 12 and is preferably connected via a threaded connection 22 to a water gun manifold 24. A pick up tube 26 extends into the pressurizable storage tank 20 from the water gun manifold 24. As shown in FIGS. 1, 2 and 4–6, the pressurizable storage tank 20 is preferably a generally cylindrically shaped bottle which can be unthreaded and removed from the water gun manifold 24 for refilling, if necessary. With regard to the threaded connection, though a threaded connection is preferred, it will be recognized by those skilled in the art from the present disclosure that any suitable connection is within the scope of the invention.

As shown in FIG. 1, a path of fluid communication is made up of a conduit 25 and a pipe 44. The manifold 24 is connected to a release valve 28 located in the housing 12 via the conduit 25. The release valve 28 is actuated via a trigger 30 which is connected to the release valve 28 and mounted in the housing 12 adjacent to the handle 14. The trigger 30 is preferably spring biased to a first position in which the valve 28 remains closed. Pulling on the trigger 30 causes the valve stem 32 to be retracted, opening the valve 28. Preferably, a delay spring 34 is located between the trigger actuator 36 and the valve stem 32. The trigger actuator 36 is connected to the trigger 30 at an interlocking connection 38.

A pump 40 is connected to the housing 12 and includes a pump handle 42 which extends from the front of the water gun 10. The pump 40 is connected to the manifold 24 via the pipe 44. A check valve 46 is located between the end of the pipe 44 and the pump 40 in fluid communication with the pump 40 and the pressurizable fluid storage tank 20, in order to allow air to be pumped by the pump 40 through the pipe 44 and into the manifold 24 to pressurize water or liquid located in the storage tank 20. The check valve 46 also prevents back pressure from entering the pump 40.

Figure 3:
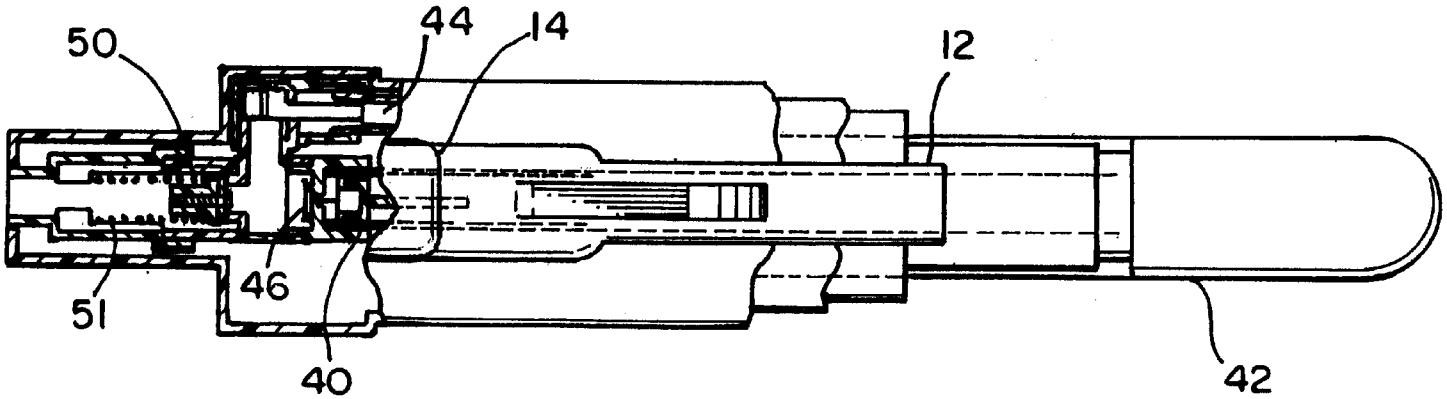
FIG. 3 is a bottom view, partially in cross section, taken along lines 3—3 in FIG. 1.
Figure 4:
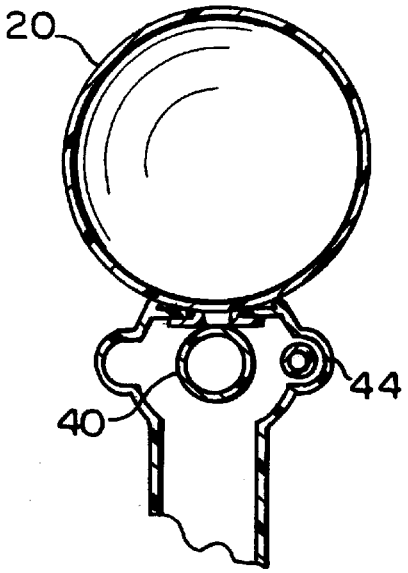
FIG. 4 is a cross-section taken along lines 4—4 in FIG. 1.
Figure 5:
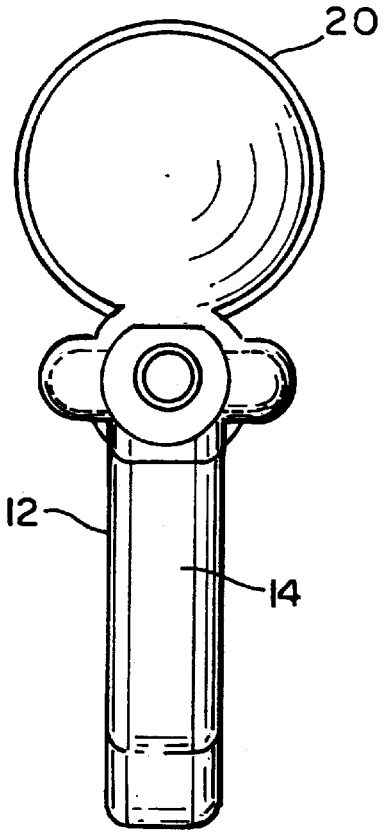
FIG. 5 is a rear elevational view thereof.
Figure 6:
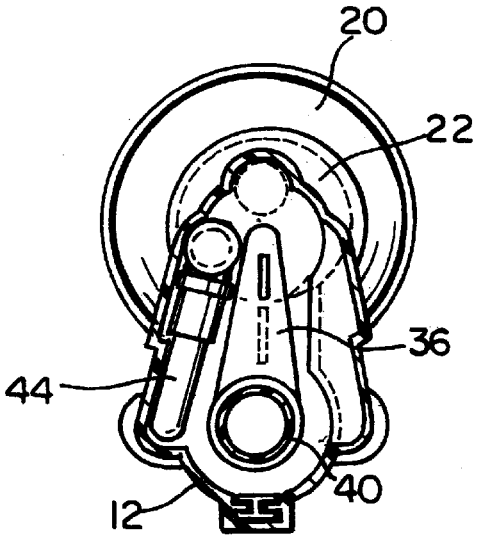
FIG. 6 is a cross-sectional view of the water gun in accordance with the present invention taken along lines 6—6 in FIG. 1.
Figure 7:
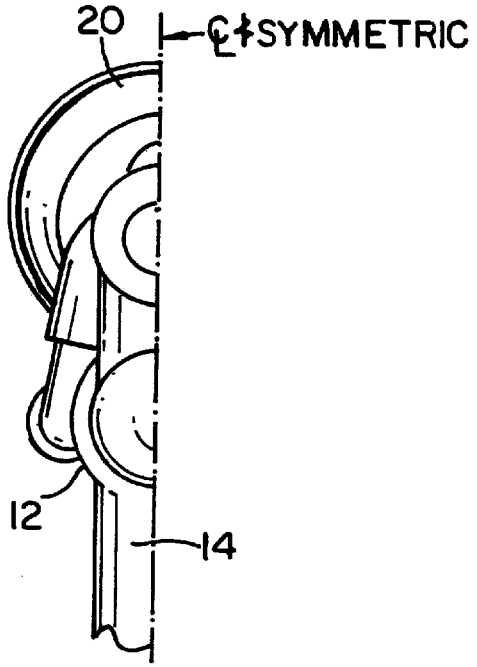
FIG. 7 is a front elevational view, with only the left side being illustrated since the water gun profile is symmetric about the center line.

Referring to FIGS. 1 and 3, preferably, a pressure release valve 50 which is set at a desired pressure in order to prevent over-pressurization of the water gun 10 is connected to the path of fluid communication, and in particular to the pipe 44. Preferably, the pressure release valve 50 includes a spring 51 which biases the valve 50 to a closed position and opens when acted upon by a sufficient pressure. However, it will be recognized by those skilled in the art from the present disclosure that the pressure release valve 50 may be set at any desired value in order to prevent over-pressurization of the water gun 10, including the manifold 24 and the water tank 20.

Figure 8:
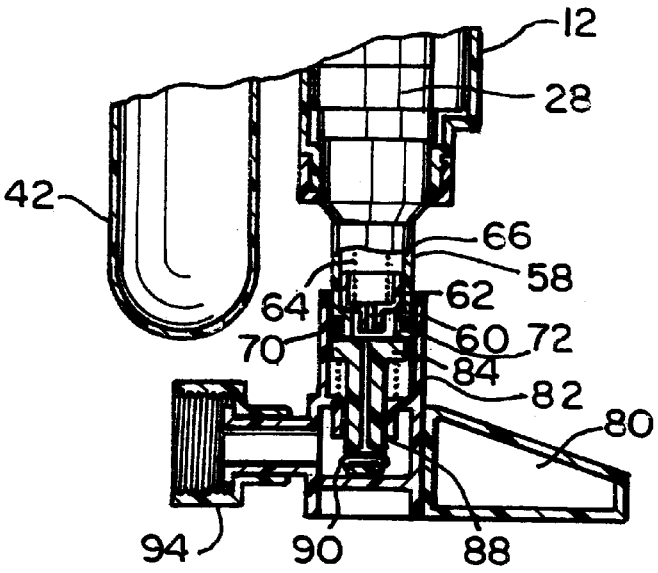
FIG. 8 is a partial elevational view, partially in cross-section, of the nozzle of the toy water gun shown in FIG. 1 being inserted in a recharge adapter in accordance with the present invention.
Figure 9:
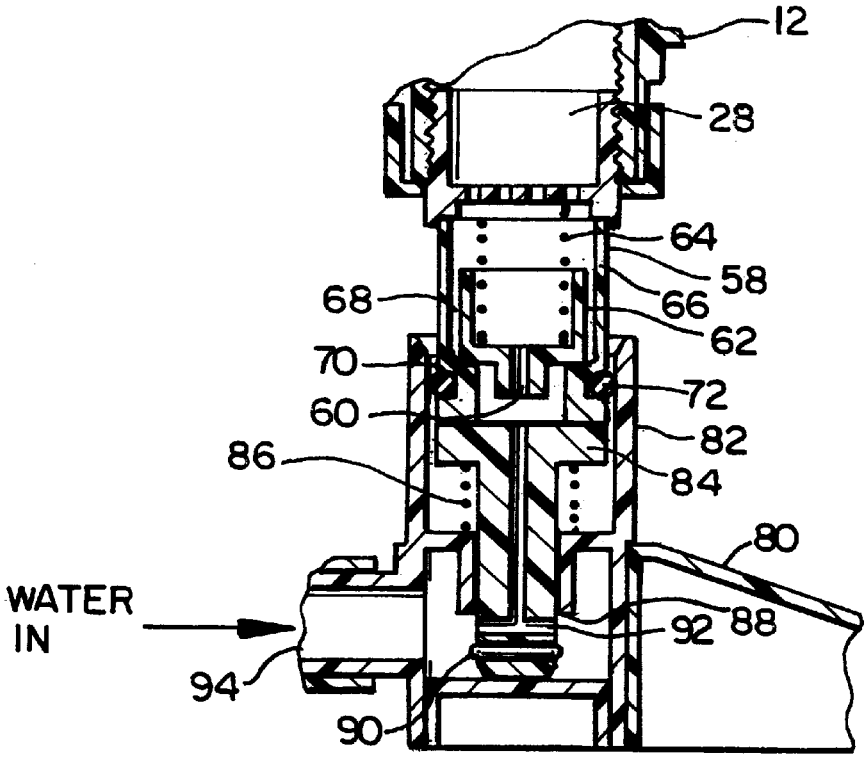
FIG. 9 is a greatly enlarged elevational view, partially in cross section, of a portion of FIG. 8.

Referring now to FIGS. 1, 8 and 9, a nozzle assembly 58 is located on the front of the water gun 10 and is in fluid communication with the release valve 28. The nozzle assembly 58 is adapted for insertion into a recharge adapter 80, as explained in detail below, to force liquid through the nozzle assembly 58 to displace the release valve 28 such that liquid flows through part of the path of fluid communication and into the pressurizable storage tank 20. The nozzle assembly 58 includes a nozzle assembly housing 66. A sliding nozzle member 62 is located in the nozzle assembly housing 66 and a nozzle discharge opening 60 is located in the sliding member 62. The discharge opening 60 has a first size. The sliding nozzle member 62 is biased by a spring 64 to a forward most position within the nozzle assembly housing 66. The sliding nozzle member 62 includes at least one recharge channel 68 located between the sliding nozzle member 62 and the nozzle assembly housing 66. As shown in detail in FIG. 9, preferably a plurality of recharge channels 68 are located around the periphery of the sliding nozzle member 62 to allow for an increased flow area between the sliding nozzle member 62 and the wall of the housing 66 during recharging as the sliding nozzle member 62 is moved rearwardly in the nozzle assembly housing 66. The at least one channel 68 for recharging is a different size, preferably having a larger area than the discharge opening 60. A spring is positioned to bias the sliding nozzle member 62 to a first position to block the recharge channels 68. As explained in detail below, the sliding nozzle member 62 is adapted to move to a second position during recharging to open the recharge channels 68. The outside of the nozzle assembly housing 66 includes a groove 70 for an O-ring seal 72 at the forward end. However, it will be recognized by those skilled in the art from the present disclosure that different types of valve assemblies can be utilized, and that the sliding member 62 can be omitted, if desired.

The water gun 10 can be charged through a recharge adapter 80 which is adapted to be connected to an external source of pressurized water, such as city water, by placing the nozzle assembly 58 into the recharge adapter 80.

As shown in detail in FIGS. 8 and 9, the recharge adapter 80 includes a receptacle 82 for receiving the nozzle assembly 58 of the water gun 10. A valve body 84 is located in the adapter 80 and is held in a closed position via a spring 86 located in the receptacle 82. The valve body 84 is held by the spring 86 in a closed position against a seat 88 located in the recharge adapter 80 and is sealed via an O-ring 90. A path 92 is located in the valve body 84 such that upon downward movement of the valve body 84, to the position shown in detail in FIG. 9, water under pressure enters the path 92 and is conveyed through the valve body 84 to the nozzle assembly 58. An external hose attachment 94, shown in FIG. 8, is provided on the recharge adapter 80. However, it will be recognized by those skilled in the art from the present disclosure that other types of connectors or couplings can be provided for attaching the recharge adapter 80 to a pressurized water source, such as city water. It will be similarly recognized that the different types of valves and actuating mechanisms can be used.

In operation, the water gun 10 can be charged by filling and pressurizing the storage tank 20 by one of two methods.

First, the water gun 10 can be charged by placing the nozzle assembly 58 into the receptacle 82 of the recharge adapter 80. This moves the normally closed valve body 84 to an open position by moving it downwardly upon contact by the nozzle assembly 58. Water under pressure then flows through the recharge adapter 80, through the nozzle assembly 58 and presses the sliding nozzle member 62 inwardly to allow a larger volume of water to flow through the at least one channel 68 located on the sliding nozzle member 62. The valve 28 is opened via water pressure acting on the closing surface of the valve 28 or mechanically upon insertion of the nozzle assembly 58 into the recharge adapter 80 in order to allow a back flow of pressurized water through the valve 28 and the conduit 25 into the manifold 24. Water flows through the manifold 24 and into the pressurizable storage tank 20, trapping and pressurizing air above the water in the tank 20 to charge the pressurizable storage tank 20 with liquid under pressure. This pressurized air provides the motive force for shooting water from the gun 10 in a similar manner to the pressurized air in the water gun disclosed in U.S. Pat. No. 5,074,437. The pressure release valve 50 prevents over-pressurization and allows water to overflow if the water pressure from the external water source is above the set value for the pressure release valve in order to prevent over-pressurization of the water gun 10 and its components. Once charged, movement of the trigger 30 regulates the discharge of pressurized water or liquid from the pressurizable storage tank 20 out of the nozzle assembly 58.

The pump 40 can be used to keep air pressure up for longer shots or the water gun can be used in a normal fashion when an external source of pressurized water is not available by directing water into the storage tank 20 by removing the storage tank 20 at the threaded connection 22, filling the water tank 20 with water and connecting to the water gun 10 via the threaded connection 22. Water in the tank can then be pressurized via the pump 40 in the known manner. Water is released from the water gun by pulling the trigger 30, which moves the trigger actuator 36 rearwardly along the outside of the pump barrel 40, compressing the delay spring 34 to such a point where the stem rapidly opens the release valve 28 in order to release a burst of water through the opening 60 in the nozzle assembly 58.

Preferably, the housing 12 of the water gun 10 is made of a molded polymeric material and the water tank 20 is also made of a polymeric material which may be blow molded. However, it will be recognized by those skilled in the art from the present disclosure that the water gun housing 12, the water tank 20 as well as the remaining components may be made of polymeric or any other suitable materials.

It will be appreciated by those skilled in the art that changes can be made to the embodiment described above without departing from the broad inventive concept thereof. It is understood, therefore, that the invention is not limited to the particular embodiment disclosed, and is intended to cover modifications within the scope and spirit of the present invention.

It is claimed:

1. A toy gun for ejecting a liquid comprising:

a housing;

a pressurizable storage tank for liquid connected to said housing;

a pump connected to said housing, said pump adapted to pressurize liquid in said pressurizable storage tank;

a release valve located in said housing;

a path of fluid communication between said pressurizable storage tank, said pump and said release valve, said release valve being adapted to regulate a discharge of liquid from said pressurizable storage tank;

a trigger connected to the release valve;

a nozzle assembly connected to the release valve and adapted for insertion into a recharge adapter to force liquid through said nozzle assembly to displace said release valve such that the liquid flows through a part of said path of fluid communication and into said pressurizable storage tank which compresses air in said pressurizable storage tank to charge the pressurizable storage tank with liquid under pressure;

wherein movement of said trigger regulates discharge of pressurized liquid from the pressurizable storage tank out of said nozzle assembly.

2. A toy gun as claimed in claim 1, wherein said nozzle assembly further comprises a discharge opening of a first size and a recharge channel of a different size.

3. A toy gun as claimed in claim 2, wherein said recharge channel has a larger area than said discharge opening.

4. A toy gun as claimed in claim 2, wherein said nozzle assembly further comprises a nozzle housing and a sliding nozzle member located therein.

5. A toy gun as claimed in claim 4, wherein said recharge channel is located between said sliding nozzle member and said nozzle assembly housing, a spring is positioned to bias said sliding nozzle member to a first position to block the recharge channel, and said sliding nozzle member is adapted to move to a second position during recharging to open said recharge channel.

6. A toy gun as claimed in claim 1, wherein a pressure release valve is connected to said path of fluid communication, said pressure release valve being adapted to open when a predetermined pressure is exceeded to prevent over-pressurization of said toy gun.

7. A toy gun as claimed in claim 1, wherein a check valve is in fluid communication with said pump and said pressurizable storage tank, said check valve being adapted to allow air to be pumped from said pump through said path of fluid communication and into said pressurizable storage tank to pressurize liquid in said pressurizable storage tank while preventing back pressure from entering said pump.

8. A toy gun system comprising:

a toy gun including a housing;

a pressurizable storage tank for liquid removably attached to said housing;

a pump connected to said housing, said pump adapted to pressurize a liquid in said pressurizable storage tank;

a release valve located in said housing;

a path of fluid communication between said pressurizable storage tank, said pump and said release valve, said release valve being adapted to regulate a discharge of liquid from said pressurizable storage tank;

a trigger connected to said release valve;

a nozzle assembly including a nozzle assembly housing connected to said release valve and adapted for insertion into a recharge adapter to force liquid through said nozzle assembly to displace said release valve such that liquid flows through a part of said path of fluid communication and into said pressurizable storage tank which compresses air in said storage tank to charge the pressurizable storage tank with liquid under pressure; and a discharge opening and at least one recharge channel located within said nozzle assembly; and the recharge adapter including a hose attachment on said recharge adapter adapted to be connected to an external source of pressurized liquid;

a valve body located in said recharge adapter having a path therethrough;

a receptacle on said adapter for receiving said nozzle assembly;

such that upon insertion of said nozzle assembly into said receptacle, said valve body is adapted to be displaced to an open position allowing pressurized liquid from the external source to travel through said recharge adapter and into said nozzle assembly.

9. A toy gun system as claimed in claim 8, wherein said nozzle assembly further comprises a sliding nozzle member.

10. A method of operating a toy gun comprising:

(a) providing a toy water gun having a housing, a handle on said housing, a storage tank removably attached to said housing, a pump attached to said housing and in fluid communication with a nozzle assembly, and a path of fluid communication between said storage tank, said pump and a release valve;

(b) filling and pressurizing said storage tank by one of:

(i) directing liquid in to said storage tank and pumping said pump to force air into said storage tank; and (ii) inserting said nozzle assembly in a receptacle of a recharge adapter thereby moving a normally closed valve to an open position, allowing liquid to flow through said normally closed valve, through said nozzle assembly and into said storage tank, pressurizing air in said storage tank;

(c) discharging liquid from said storage tank by actuating said release valve; and (d) refilling said toy gun in accordance with step (b).

11. A method of operating a toy gun as claimed in claim 10 wherein the step of directing liquid into said storage tank further includes detaching said storage tank from said housing, and, after receiving liquid in said storage tank, reattaching said storage tank to said housing.

* * * * *